United States Patent [19]

Essen

[11] Patent Number: 4,492,323

[45] Date of Patent: Jan. 8, 1985

[54] WATER PITCHER

[75] Inventor: R. Eric Essen, St. Louis, Mo.

[73] Assignee: Gateway Plastics, Inc., St. Louis, Mo.

[21] Appl. No.: 319,110

[22] Filed: Nov. 9, 1981

[51] Int. Cl.[3] ..... A47G 19/14

[52] U.S. Cl. ..... 222/465 R; 222/556

[58] Field of Search ..... 222/545, 556, 465, 470, 222/472, 474, 543, 565, 480, 566, 567; 220/339, 337

[56] References Cited

U.S. PATENT DOCUMENTS

| | | | |
|---|---|---|---|
| D. 200,018 | 1/1965 | Blocken | D58/17 |
| D. 206,345 | 11/1966 | Kelley | D44/21 |
| 1,520,845 | 12/1924 | Baker | 222/556 |
| 2,141,160 | 12/1938 | Bloomfield | 222/556 |
| 2,216,407 | 10/1940 | Bradford | 222/556 |
| 2,241,435 | 5/1941 | White | 222/556 |
| 2,734,663 | 2/1956 | Lucas | 222/556 |
| 2,805,561 | 9/1957 | Emmert et al. | 222/465 R |
| 2,940,645 | 6/1960 | Albiani | 222/565 |
| 3,117,701 | 1/1964 | Stull | 222/543 |
| 3,180,540 | 4/1965 | Tupper | 222/545 |
| 3,409,188 | 11/1968 | Wright | 222/565 |
| 3,512,686 | 5/1970 | Penniman | 222/472 |
| 3,841,528 | 10/1974 | Eisenberg | 222/143 |
| 4,059,201 | 11/1977 | Faster | 220/339 |

*Primary Examiner*—Joseph J. Rolla
*Assistant Examiner*—Kenneth Noland
*Attorney, Agent, or Firm*—Rogers, Eilers, Howell, Renner, Moore and Haferkamp

[57] ABSTRACT

A pitcher for pouring water or other liquids having a container portion. A lid is hinged at the top of the container portion allowing pivoting of the lid between an open position for access to the interior of the container and a closed position for covering same. A spout is located at the hinge, and a handle is located at the side of the pitcher opposite the spout and hinge, whereby the contents are poured, and the lid opens, in a direction away from the handle. There is also included a flap at the spout opening which is mounted for swinging movement between a closed position with the pitcher upright, and an open position with the pitcher tilted for pouring.

38 Claims, 10 Drawing Figures

FIG. 1.
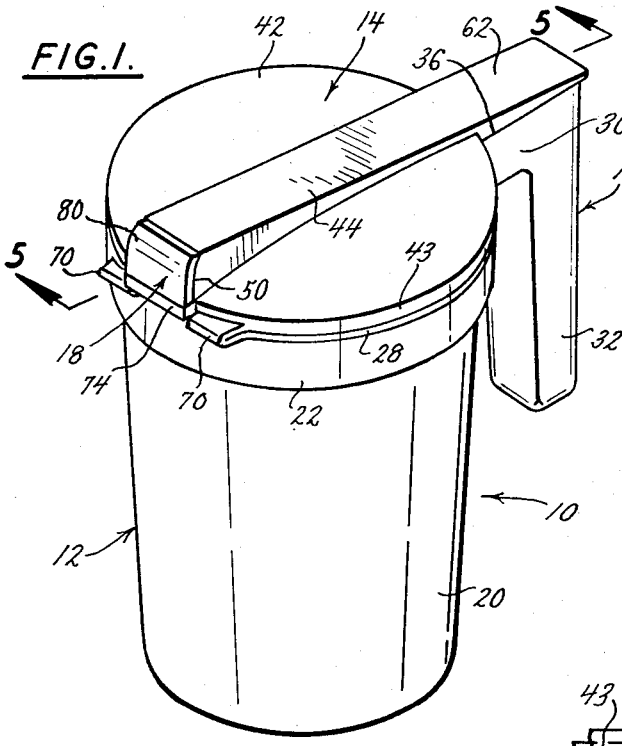
FIG. 10.
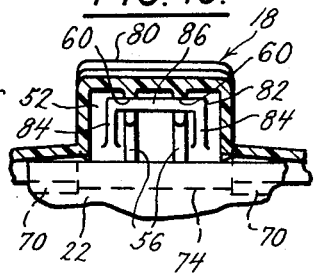
FIG. 9.
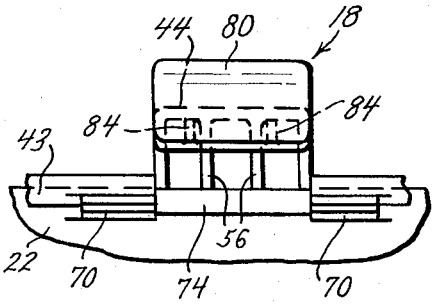
FIG. 2.
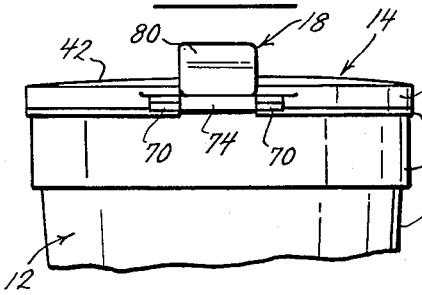
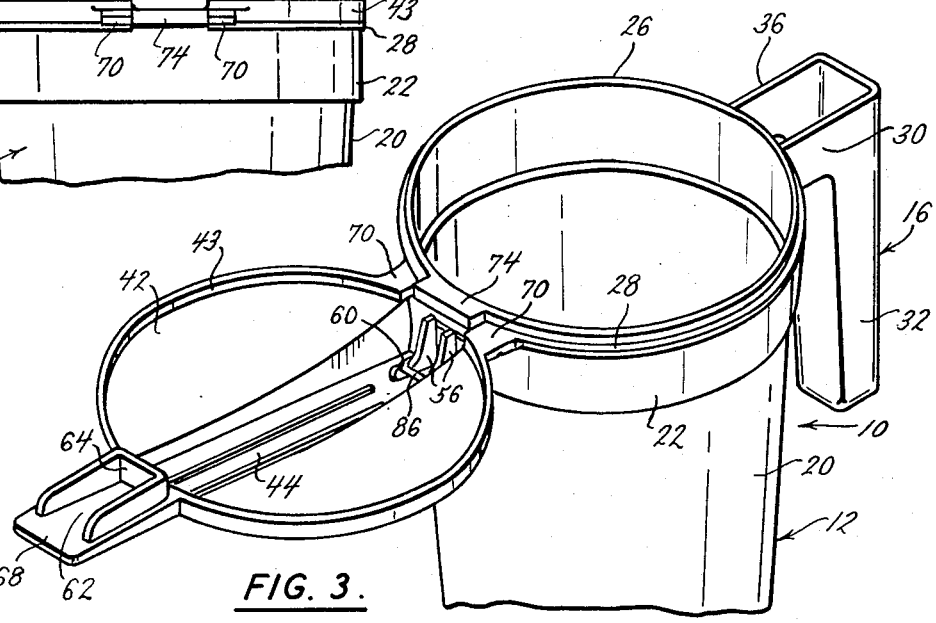
FIG. 3.

WATER PITCHER

BACKGROUND AND SUMMARY OF THE INVENTION

This invention relates generally to a pitcher, and more specifically to a pitcher for pouring liquids, such as water, into another container for consumption. The invention relates primarily to pitchers of this type that are used in hospitals, nursing homes, and the like.

It is a practice in many hospitals to provide each new patient with certain items that will remain his. A water pitcher is one such item. Because of the large number of patients and the conditions under which the pitchers are used, the pitcher must be relatively inexpensive, yet durable, safe and easy for the patient to use. It must also be designed to maintain sanitary conditions and for ease in handling by the hospital attendants.

Such pitchers are generally known in the art. Examples of these are found in U.S. Pat Nos. 3,841,528, 3,180,540 DES. 206,345, and DES. 200,018. Typically, such pitchers have a container portion, a lid that overlies the opening at the top of the container, and a spout through which the contents may be poured. In some cases the spout and/or spout opening are formed in the container portion, and in others they are formed in the lid. Typically, the lid may be either a snap on type such as shown in U.S. Pat. No. 3,180,540, or hinged as shown in U.S. Pat. Nos. 3,841,528 and DES. 200,018. Known pitchers may also include a handle such as shown in U.S. Pat. No. 3,841,528, and a cover, or hinged flap, that overlies the spout opening such as in U.S. Pat. No. 3,180,540.

The present invention represents a significant improvement over these known pitchers. The pitcher of the present invention generally comprises a container portion, and a hinged lid at the top thereof allowing pivoting of the lid between an open position for access to the interior of the container and a closed position overlying the top of the container. A spout opening, through which the contents are poured, is located at the hinge, and a handle is located at the side of the pitcher opposite the spout opening. This means that the contents are poured, and the lid opens, in a direction away from the handle. The lid has an extension which is readily engaged by the thumb for prying the lid open while grasping the handle, the handle providing leverage for opening the lid.

The invention provides several important advantages. To appreciate these advantages, it must be remembered that a pitcher for use in a hospital or similar environment must be free of contamination and otherwise safe for the patient. With this invention, the lid is secure during pouring and yet easily opened for refilling and the like without requiring handling of the interior portions of the pitcher which might otherwise become contaminated. Because the lid is hinged at the spout opening, the force of the water and ice, as they are directed toward the spout opening during pouring, is at the location where the lid is hinged so that the hinge itself acts to hold the lid closed where most of the force is directed. Only a small snap is required at the side of the lid opposite that of the hinge to hold the lid securely closed during pouring. This small snap is easily overcome by prying upwardly with the thumb on the lid extension, aided by the leverage provided by the handle. The extension provides a convenient means for opening the lid at a location sufficiently remote from the spout and other areas contacted by the contents of the pitcher to minimize contamination that might otherwise result from touching those areas. Also, with the lid hinged at the location of the spout opening, considerable leverage is applied by use of only the small snap or the like at the side of the lid opposite the spout to ensure a tight seal between the lid and the top of the container portion, particularly at the locations nearest the spout opening, to prevent leakage between the lid and the container.

The entire pitcher may be of molded, one-piece, plastic construction, and thus inexpensive with the advantage that the lid, container and handle require no assembly and are permanently attached together for ease in handling. Moreover, with the lid hinged at the side opposite the handle, the lid and handle tend to balance with the lid open so that the pitcher is stable in an upright position even when empty for ease in filling. This eliminates the need to hold the pitcher upright with one hand while trying to fill it with the other.

The invention also includes a hinged flap, which is also of molded, one-piece, plastic construction, and which swings between a closed position overlying the spout opening with the pitcher in the upright position, and an open position when the pitcher is tilted for pouring. The flap is readily snapped into place during assembly so that no pins or the like are required. The flap includes a cover portion which overlies the spout opening, and a radius arm means extending therefrom forming an acute angle with the cover portion, whereby as the flap swings open, the entire cover portion moves upwardly and away from the spout opening to a limited open position so that in the open position the cover portion of the flap acts to direct the liquid contents out of the container in a controlled manner. Ice guards extend over the spout opening to prevent ice and other large objects from passing through the opening. The guards provide another important function by retaining the flap in the event the flap comes loose from the lid, so that the flap will not fall into the drinking receptacle.

These and other objects and advantages of the invention will be further discussed and will be apparent from the drawing and detailed description to follow.

DESCRIPTION OF THE DRAWINGS

FIG. 1 is an isometric view of a pitcher of the present invention;

FIG. 2 is a front elevation showing the upper portion of FIG. 1;

FIG. 3 is an isometric view similar to FIG. 1, but showing the lid in the opened position;

FIG. 9 is a view taken generally along the line 9—9 of FIG. 7; and

FIG. 10 is a view in section taken generally along the line 10—10 of FIG. 5.

DETAILED DESCRIPTION OF THE PREFERRED EMBODIMENT

Figure 5:
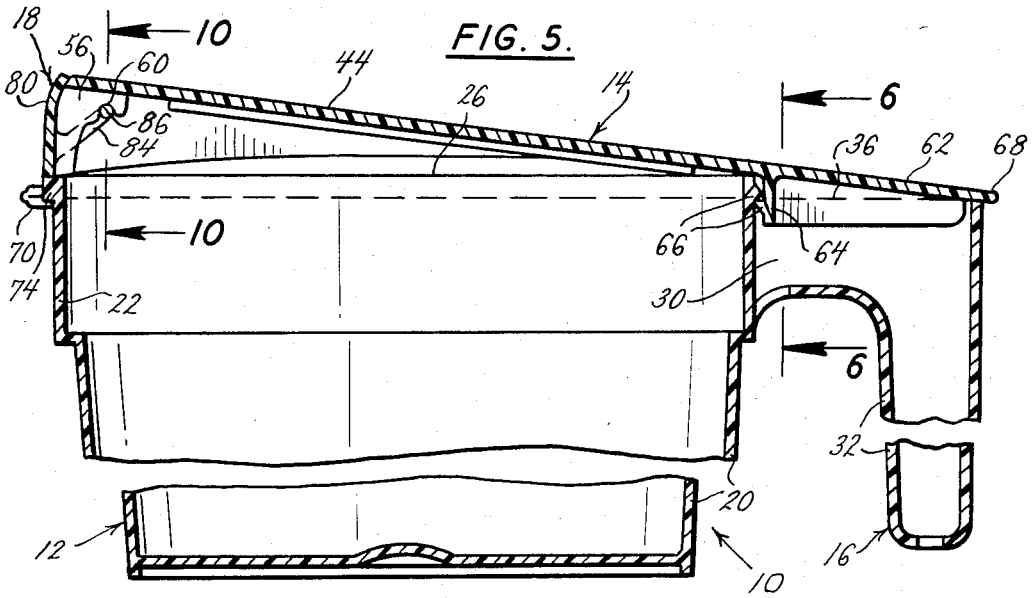
FIG. 5 is an enlarged view in section taken generally along the line 5—5 of FIG. 1.
Figure 6:
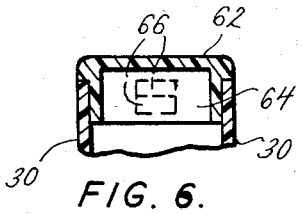
FIG. 6 is a view in section taken generally along the line 6—6 of FIG. 5.

With reference to the drawing, there is generally shown a pitcher 10 of the present invention having a container portion 12 for holding the contents which may be typically water and ice. There is also included a hinged lid 14, a handle 16, and a flap or cover 18 for the spout opening.

The container portion 12 is of circular cross section and has a tapered lower portion 20, which is larger at the top than at the bottom, and an enlarged generally cylindrical top portion 22. The portion 22 is somewhat larger than the upper end of the tapered portion 20 so that the pitchers will rest when stacked. The upper edge of the portion 22 defines the opening 26 of the container, and an annular, outwardly extending, rim 28 extends around the container near the upper edge, and acts to seal the lid to the container.

Figure 4:
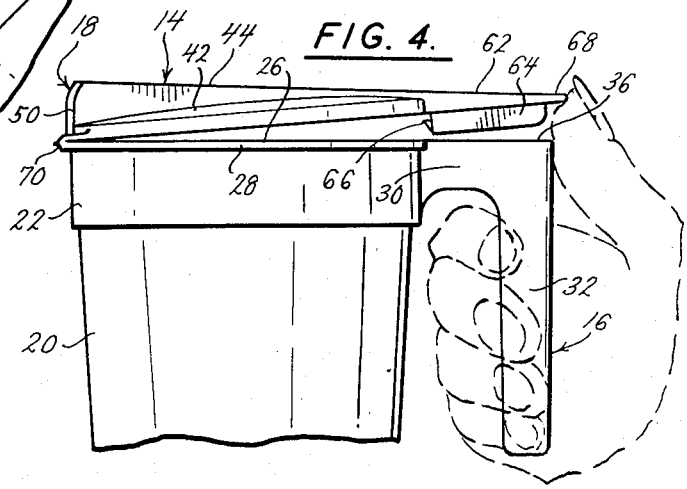
FIG. 4 is a side elevation of the pitcher of FIG. 1, but showing the lid in a partially opened position and illustrating the manner in which the lid may be opened.

The handle 16 is formed integrally with the container portion and is located at one side (rear side) of the container. In the preferred embodiment, the handle is hollow and has a generally horizontal upper portion 30 secured to the upper portion 22 of the container, and a handle grip 32 extending downwardly therefrom and spaced from the container sufficiently to allow the user to grasp the handle grip with the fingers of one hand as illustrated in FIG. 4. The handle has an upper edge 36 defining a top opening of the handle with the edge 36 generally aligned with the top of the rim 28.

The lid 14 has a generally flat disc portion 42, a downwardly extending annular flange 43 at the periphery, and a raised tapered channel 44 defining a spout and lid extension. The channel 44 extends generally diametrically across the lid and is tapered such that the channel is deeper at the forward end than at the rearward, or handle side, of the lid. The channel has a front edge which itself is tapered and slightly curved at the top, and which defines the spout opening 52 through which the liquid contents may be poured from the pitcher. Thus, the front edge 50 of the spout is not vertical with the pitcher in the upright position, but instead, is tapered back and slightly curved at the top as shown in FIGS. 4 and 5. This ensures closure of the flap 18 under its own weight with the pitcher in the upright position.

Formed integrally with the lid and extending downwardly therefrom at the spout opening, are webs 56 which act as ice guards to prevent ice and other large objects from passing through the spout opening. The webs are sufficiently long so that they extend to the top edge 26 of the container when the lid is closed as shown in FIGS. 5, 7, 9 and 10. Each web has a portion extending rearwardly from the spout opening and has a recess 60 (FIGS. 3, 5 and 7) located near the top of the channel 44 for hingedly mounting the flap 18 as will be further described.

In alignment with the channel 44 and extending rearwardly therefrom is a thumb engaging lid extension 62 which overlies the handle opening with the lid closed. The thumb engaging extension is formed integrally as part of the lid and has a member 64 extending downwardly therefrom and into the top of the handle with the lid closed. The member 64 and top of the container have raised tapered members 66 which engage or snap together to releasably hold the lid closed. The lid extension 62 has a rearward overhang or lip 68 which extends slightly beyond the rear side of the handle, for engagement by the thumb while grasping the handle grip with the fingers of one hand, for prying the lid open as illustrated in FIG. 4. In prying the lid open, the handle provides leverage for releasing the snap means which are located near where the thumb pressure is applied for ease in opening the lid.

The lid is hinged at the top of the container at the location of the spout opening so that both the hinge and the spout are at the side of the container opposite the handle. More specifically, the hinge is formed integrally with the container portion and lid and includes web portions 70 on opposite sides of the spout opening with each web portion extending between the rim 28 and the flange 43. A double seal is formed between the lid and container. The dimensions of the flange 43 are such that with the lid closed, the flange surrounds the upper edge of the container portion with the bottom edge of the flange engaging the rim 28, thus forming a liquid seal between the flange and the rim. Another seal is formed between the top edge of the container and the disc portion of the lid. This double sealing is enhanced by the fact that the lid is in effect a lever operated by the small snap 66 or by downward pressure of the thumb during pouring to effect a seal between the flange and rim particularly over the forward portion of the lid most often contacted by the liquid during pouring. A short lip 74 is located between the hinge members 70 at the location of the rim 28.

Figure 7:
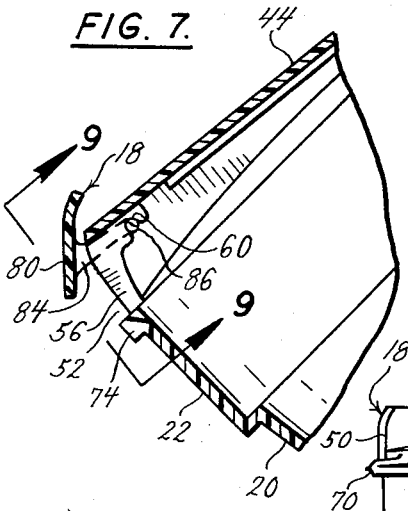
FIG. 7 is a sectional view similar to FIG. 5, but showing that portion of the pitcher near the spout opening and showing the flap of the present invention in the opened position.
Figure 8:
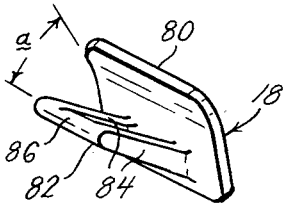
FIG. 8 is an isometric view of the flap of the present invention.

The flap 18 includes a cover 80 of the same profile as the spout opening which overlies the spout opening with the pitcher in the upright position as shown in FIGS. 1, 2, 4 and 5. A radius arm 82 extends rearwardly from the cover at an acute angle a (FIG. 8) and from a location of the cover nearer its bottom edge than its top. More specifically, the radius arm 82 comprises spaced arms 84 and a cross bar 86 which seats in snapping engagement in the recesses 60 of the webs 56. As shown in FIG. 7 (see also FIG. 9), when the pitcher is tilted to the pouring position, the flap swings by its own weight, aided by the liquid impinging on the inner surface of the cover portion, to an open position. With the flap in the fully open position as shown in FIG. 7, the arms 84 engage the top of the channel of the lid to restrict further swinging movement of the flap. With the flap so restricted, the liquid continues to impinge upon the inner surface of the cover portion with the cover portion acting to direct the liquid downwardly toward the container into which it is poured. It will further be noted, that as the flap swings from its closed to its open position, the entire cover portion swings upwardly and away from the spout opening.

It should be noted that the only assembly required is to attach the flap to the lid which is accomplished by simply opening the lid and snapping the cross bar 86 into the recesses 60. In the unlikely event that the cross bar comes out of the recess during pouring, the flap is retained by the webs to prevent the flap from falling with the water into the drinking cup.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A pitcher for pouring liquid comprising a container portion having a top opening, a lid hinged at the top of the container portion near the periphery thereof allowing pivoting of the lid between an open position for access to the interior of the container and a closed position over the container opening, said top opening and lid being sized to expose substantially the entire interior of said container portion with the lid open, said pitcher having a spout opening near the periphery of said container portion on the same side as said hinge for the pouring of the contents therethrough.

2. The pitcher of claim 1 wherein said spout is formed in said lid, said lid having a raised channel defining a spout leading to the spout opening.

3. The pitcher of claim 1 further comprising a rim extending around the top of the container portion, said lid having an edge engaging said rim to effect a liquid seal therebetween.

4. The pitcher of claim 1 wherein said container, lid, and hinge are of one piece, molded, plastic construction.

5. The pitcher of claim 4 wherein said hinge comprises flexible web members on opposite sides of the spout opening.

6. The pitcher of claim 1 further comprising guard means at the spout opening preventing the passage of large objects, while allowing the passage of liquid, therethrough.

7. The pitcher of claim 1 further comprising a flap at said spout opening, and means for mounting said flap for swinging movement between a closed position with the pitcher upright and an open position with the pitcher tilted for pouring.

8. The pitcher of claim 7 wherein said flap has a cover portion that overlies the spout opening when in the closed position, and said mounting means provides swinging movement of the entire cover portion upwardly and outwardly relative to the spout opening as the pitcher is tilted from an upward to a pouring position.

9. The pitcher of claim 8 further comprising means limiting the maximum opening of said flap, whereby with the flap in its fully opened position, liquid pouring through the spout opening impinges upon the cover portion and is directed downwardly therefrom.

10. The pitcher of claim 8 wherein said flap further comprises a radius arm extending rearwardly from the cover portion, said radius arm defining the swinging movement of said flap.

11. The pitcher of claim 10 wherein said radius arm further comprises a cross bar at the rearward end thereof defining the swinging axes of said flap.

12. The pitcher of claim 10 wherein the radius arm extends rearwardly from the cover portion at a location spaced downwardly from the upper edge of the cover portion, the angle defined by the radius arm and the upper portion of the cover portion being an acute angle.

13. The pitcher of claim 10 wherein the maximum opening of said flap is defined by restrictive movement of said radius arm.

14. The pitcher of claim 10 further comprising guard means at the spout opening for preventing the passage of large objects, while allowing the passage of liquid, therethrough, said guard means having recesses therein for pivotally receiving said radius arm.

15. The pitcher of claim 8 wherein said spout opening is tapered rearwardly from bottom to top of the opening, whereby with the pitcher in the upright position, the flap cover under its own weight overlies the spout opening.

16. The pitcher of claim 1 further comprising a handle.

17. A pitcher for pouring liquid comprising a container portion having a top opening, a lid hinged at the top of the container portion near the periphery thereof allowing pivoting of the lid between an open position for access to the interior of the container and a closed position over the container opening, said top opening and lid being sized to expose substantially the entire interior of said container portion with the lid open, said pitcher having a spout opening near the periphery of said container portion on the same side as said hinge for the pouring of the contents therethrough, and a handle at the side of the pitcher opposite the spout and hinge, whereby said contents are poured, and said lid opens, in a direction away from said handle.

18. The pitcher of claim 17 wherein said lid has an extension opposite its hinged side for engagement by the thumb.

19. The pitcher of claim 18 wherein said extension has a lip projecting beyond the handle and positioned for engagement by the thumb to pry the lid from its closed position while grasping the handle with the fingers of the hand, said handle providing leverage for prying the lid.

20. The pitcher of claim 19 further comprising releasable means for holding the lid in closed engagement over said container opening, said releasable means being near said lip, whereby thumb pressure acting on the lip to pry open the lid is located near the releasable means.

21. The pitcher of claim 18 wherein said lid extension overlies the top of the handle, and further comprising releasable means for releasably holding the lid in closed engagement over said container opening.

22. The pitcher of claim 17 wherein said spout opening is formed in said lid, said lid having a raised channel defining a spout leading to the spout opening.

23. The pitcher of claim 17 further comprising a rim extending around the top of the container portion, said lid having an edge engaging said rim to effect a liquid seal therebetween.

24. The pitcher of claim 17 wherein said container, handle, lid, and hinge are of one piece, molded, plastic construction.

25. The pitcher of claim 24 wherein said hinge comprises flexible web members on opposite sides of the spout opening.

26. The pitcher of claim 17 further comprising guard means at the spout opening preventing the passage of large objects, while allowing the passage of liquid, therethrough.

27. In a pitcher for pouring liquid, having a container portion and a spout opening for the pouring of the contents therethrough: a flap at said spout opening, means for mounting said flap for swinging movement between a closed position with the pitcher upright and an open position with the pitcher tilted for pouring, said flap having a cover portion that overlies the spout opening when in the closed position, and having a radius arm extending rearwardly from the cover portion at a location spaced downwardly from the upper edge of the cover portion, the angle defined by the radius arm and the upper portion of the cover portion being an acute angle, and said mounting means further providing swinging movement of the entire cover portion upwardly and outwardly relative the spout opening as the pitcher is tilted from its upright to its pouring position, said radius arm defining the swinging movement of said flap.

28. The pitcher of claim 27 wherein said radius arm further comprises a cross bar at the rearward end thereof defining the swinging axis of said flap.

29. The pitcher of claim 27 wherein the maximum opening of said flap is defined by restrictive movement of the radius arm.

30. The pitcher of claim 27 wherein the spout opening is tapered rearwardly from bottom to top of the opening, whereby with the pitcher in the upright position, the flap cover under its own weight overlies the spout opening.

31. The pitcher of claim 27 further comprising guard means at the spout openings for preventing the passage of large objects, while allowing the passage of liquid, therethrough, said guard means having recesses therein for pivotally receiving said radius arm.

32. In a pitcher for pouring liquid having a container portion and a spout opening for the pouring of the contents therethrough: a flap at said spout opening, hinge means for mounting said flap for swinging movement between a closed position with the pitcher upright and an open position with the pitcher tilted for pouring, said flap having a cover portion that overlies the spout opening when in the closed position, and retaining means for retaining said flap in engagement with said pitcher should said hinge means fail while pouring, said retaining means further comprising guard means at the spout opening, said guard means also preventing the passage of large objects, while allowing the passage of liquid, therethrough.

33. In the pitcher of claim 32 wherein said flap further comprises a cross bar defining the swinging axis of said flap, said pitcher further comprising means defining recesses receiving said cross bar to define said hinge means, said cross bar engaging said guard means to prevent disengagement of said flap from said pitcher in the event of release of the cross bar from said recesses during pouring.

34. In the pitcher of claim 33 wherein said flap further comprises a radius arm extending rearwardly from the cover portion, said radius arm defining the swinging movement of said flap, said cross bar being at the rearward end of said radius arm defining the swinging axis of said flap, said flap, radius arm, and cross bar being of one piece, molded, plastic construction.

35. A pitcher for pouring liquid comprising a container portion having a top opening, a lid hinged at the top of the container portion allowing pivoting of the lid between an open position for access to the interior of the container and a closed position over the container opening, said pitcher having a spout opening on the same side as said hinge for pouring of the contents therethrough, and a handle at the side of the pitcher opposite the spout and hinge, said lid having an extension at the handle side of the pitcher extending generally to at least the periphery of the top of the container portion allowing the user to pry upwardly on said extension with the thumb to open the lid while grasping the handle with the fingers, whereby said contents are poured and said lid opens, in a direction away from said handle.

36. The pitcher of claim 35 wherein said lid extension extends over the top of the handle.

37. A pitcher for pouring liquid comprising a container portion having a top opening, a lid hinged at the top of the container portion allowing pivoting of the lid between an open position for access to the interior of the container and a closed position over the container opening, said pitcher having a spout opening on the same side as said hinge for the pouring of the contents therethrough, and a handle at the side of the pitcher opposite the spout and hinge, said lid having an extension opposite its hinged side overlying the top of the handle allowing the user to engage the lid with the thumb while grasping the handle with the fingers during pouring, and releasable means for releasably holding the lid in closed engagement over said container opening, whereby said contents are poured, and said lid opens, in a direction away from said handle.

38. A pitcher for pouring liquid comprising a container portion having a top opening, a lid hinged at the top of the container portion allowing pivoting of the lid between an open position for access to the interior of the container and a closed position over the container opening, said pitcher having a spout opening on the same side as said hinge for the pouring of the contents therethrough, and a handle at the side of the pitcher opposite the spout and hinge, a flap at said spout opening, and means for mounting said flap for swinging movement between a closed position with the pitcher upright and an open position with the pitcher tilted for pouring, whereby said contents are poured, and said lid opens, in a direction away from said handle.

* * * * *